US008421579B2

(12) United States Patent
Chiu

(10) Patent No.: US 8,421,579 B2
(45) Date of Patent: Apr. 16, 2013

(54) CURRENT PROTECTION DEVICE

(76) Inventor: Hung-Chih Chiu, Taipei (TW)

( * ) Notice: Subject to any disclaimer, the term of this patent is extended or adjusted under 35 U.S.C. 154(b) by 250 days.

(21) Appl. No.: 12/902,163

(22) Filed: Oct. 12, 2010

(65) Prior Publication Data

US 2012/0087067 A1 Apr. 12, 2012

(51) Int. Cl.
*H01H 85/06* (2006.01)

(52) U.S. Cl.
USPC ..... 337/206; 337/265; 361/833

(58) Field of Classification Search ..... 361/833; 337/206, 265
See application file for complete search history.

(56) References Cited

U.S. PATENT DOCUMENTS 5,914,649 A * 6/1999 Isono et al. ..... 337/290
6,373,371 B1 * 4/2002 Doerrwaechter et al. ..... 337/297
7,116,208 B2 * 10/2006 Nishimura et al. ..... 337/296
7,812,704 B2 * 10/2010 Darr et al. ..... 337/243
7,932,805 B2 * 4/2011 Darr et al. ..... 337/243
2004/0184211 A1 * 9/2004 Bender et al. ..... 361/104
2008/0258856 A1 * 10/2008 Kennedy et al. ..... 337/243
2009/0102595 A1 * 4/2009 Pachla et al. ..... 337/297

* cited by examiner

*Primary Examiner* — Anthony Q Edwards

(57) ABSTRACT

A current protection device includes stacking first substrate, support layer, circuit layer, and second substrate. The surface of the first substrate attached to the support layer is an arrangement surface, and the surface of the second substrate attached to the circuit layer is a contact surface. The contact surface has a second recess, and the arrangement surface selectively has a first recess. The recesses serve to release pressure and to ensure the circuit is entirely blown by over current so as to prevent an arc effect. Besides the over current protection for electric equipment, the current protection device can be applied to light and small electronic device.

5 Claims, 8 Drawing Sheets

CURRENT PROTECTION DEVICE

FIELD OF THE INVENTION

The present invention relates to current protection device, and particular to a current protection device capable of preventing an arc effect and can be applied to light and small electronic device.

DESCRIPTION OF THE PRIOR ART

Prior fuses are made by two stacking substrates with a fuse arranged between the stacking substrates. Electrode connected to the fuse is arranged to two ends of the solid substrates respectively.

While an over current passing through the fuse, the fuse should be blown ideally. However, the fuse might not completely broke by the covering of the solid substrates so that an arc effect might happened. In such case, the fuse can not protect the equipment from damage of the over current.

Therefore, such fuse can not be applied to light, small electronic devices and can not fulfill present market demand.

SUMMARY OF THE PRESENT INVENTION

Accordingly, the primary objective of the present invention is to provide a current protection device can be applied to light and small electronic device for over current protection. The present invention can also prevent an arc effect while a blowing is happening.

The recess, auxiliary recess, and the through hole of the present invention serve to ensure the circuit is blown entirely by over current so as to prevent the arc effect for protecting the electronic device from being damaged.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
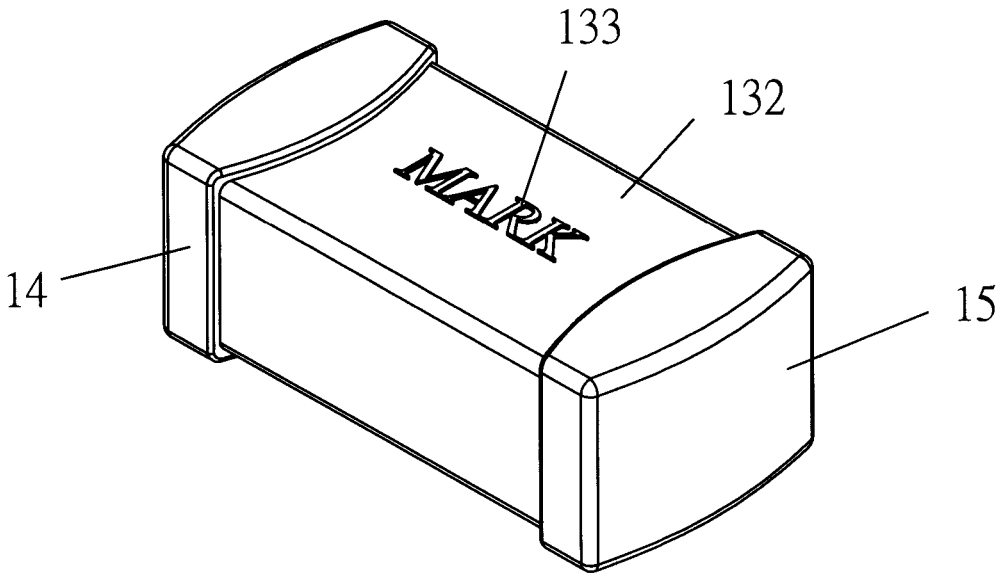
FIG. 1 is a schematic view of a current protection device of the present invention.
Figure 2:
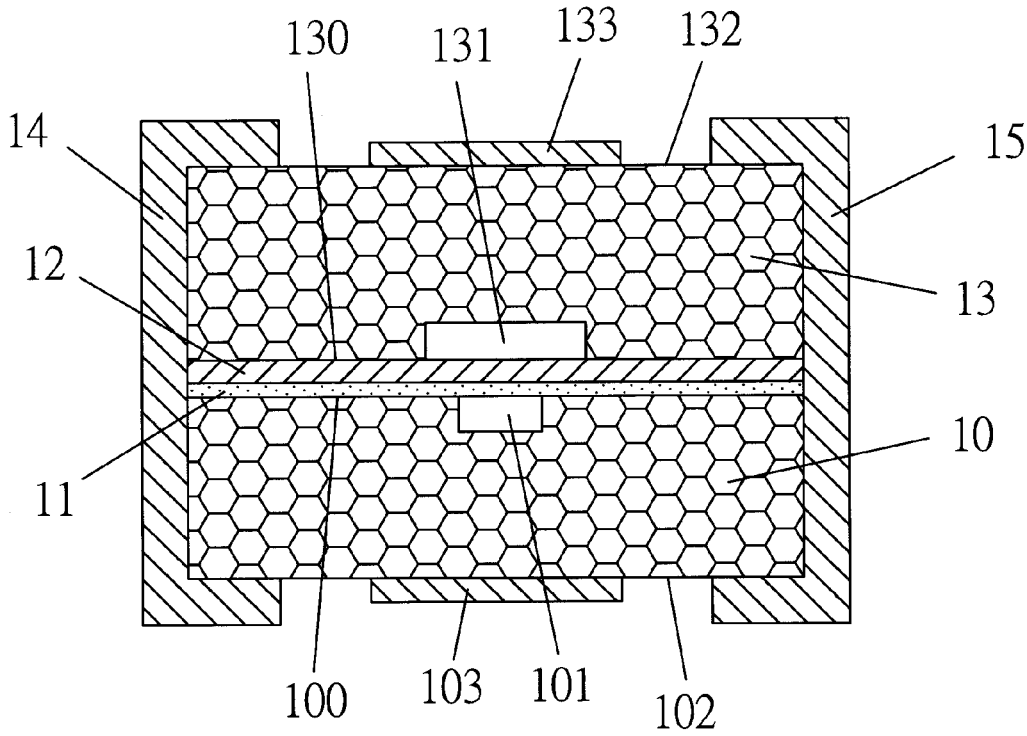
FIG. 2 is a cross-section view showing a first embodiment of the present invention.

Referring to FIGS. 1 and 2, a first embodiment of a current protection device according to the present invention is illustrated. The current protection device includes a first substrate 10, support layer 11, circuit layer 12, second substrate 13, and two electrodes 14 and 15.

The first substrate 10 and the second substrate 13 is stacked with the support layer 11 and circuit layer 12 arranged between. An arrangement surface 100 of the first substrate 10 is attached to the support layer 11. The arrangement surface 100 selectively has a first recess 101. Another surface opposite to the arrangement surface 100 of the first substrate 10 is a display surface 102. The display surface 102 selectively has a marking 103. A contact surface 130 of the second substrate 13 is attached to the circuit layer 12. The contact surface 130 has a second recess 131. The second recess 131 is larger than the first recess 101. Another surface opposite to the contact surface 131 is a display surface 132. The display surface 132 selectively has a marking 133. The markings 133 and 103 can be specification or words.

The electrodes 14 and 15 cover the two ends of the stacking substrates, and the electrodes 14 and 15 are electrically connected to the circuit layer 12.

Figure 3:
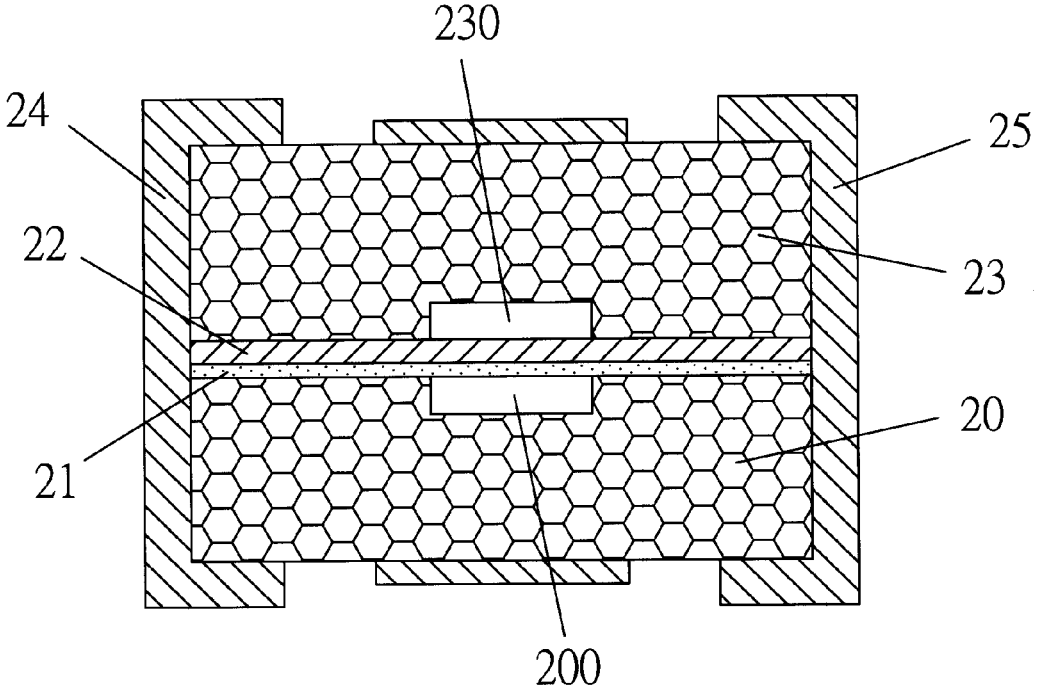
FIG. 3 is a cross-section view partially showing a second embodiment of the present invention.

Referring to FIG. 3, a second embodiment of the current protection device according to the present invention is illustrated. Just like the first embodiment, the current protection device includes a first substrate 20, support layer 21, circuit layer 22, second substrate 23, and two electrodes 24 and 25. The electrodes 24 and 25 cover the two ends of the stacking substrates. A first recess 200 has the same volume as a second recess 230.

Figure 4:
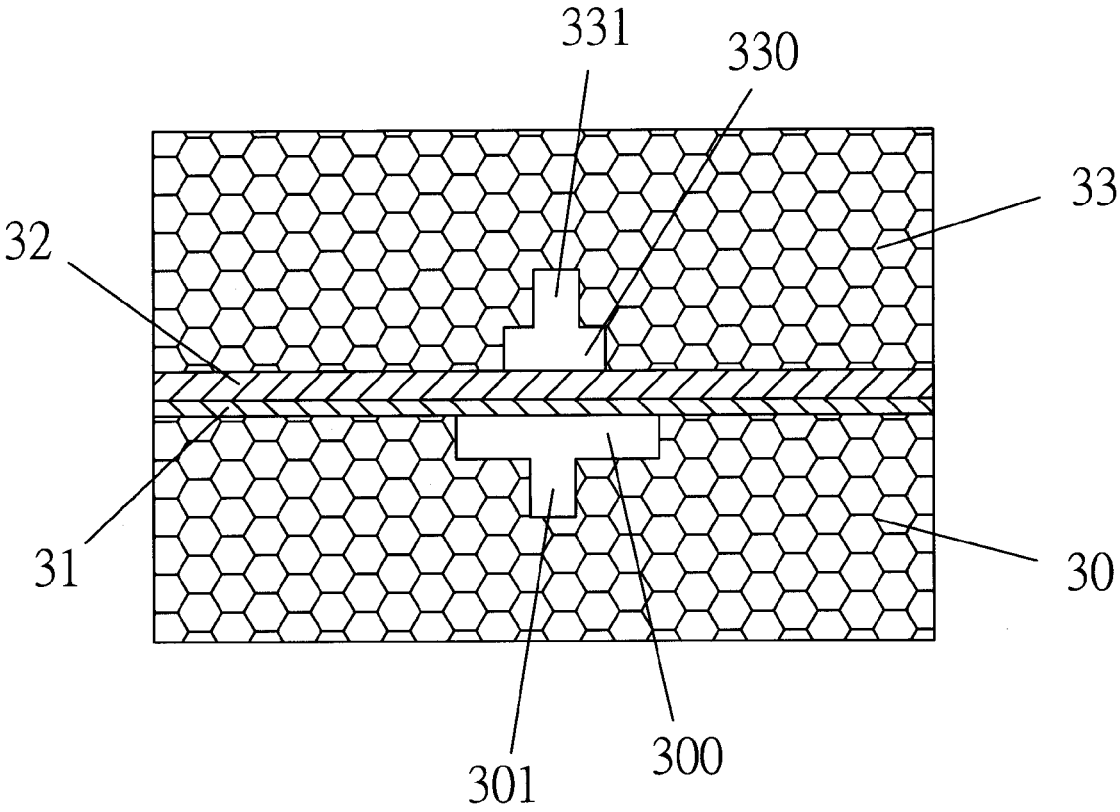
FIG. 4 is a cross-section view partially showing a third embodiment of the present invention.
Figure 5:
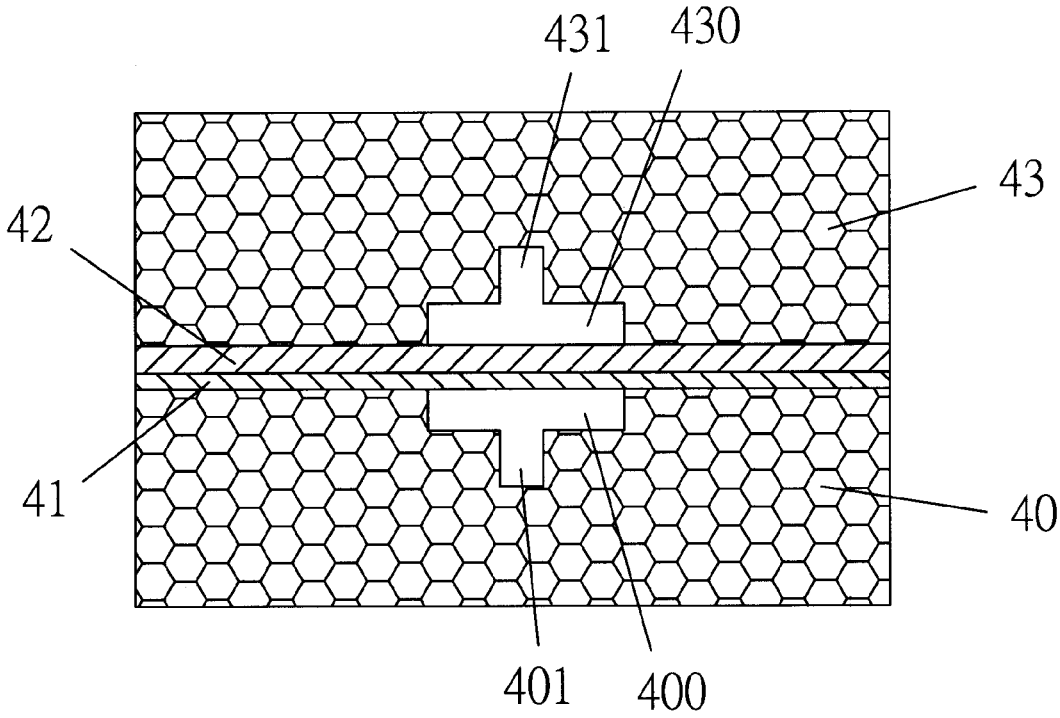
FIG. 5 is a cross-section view partially showing a fourth embodiment of the present invention.
Figure 6:
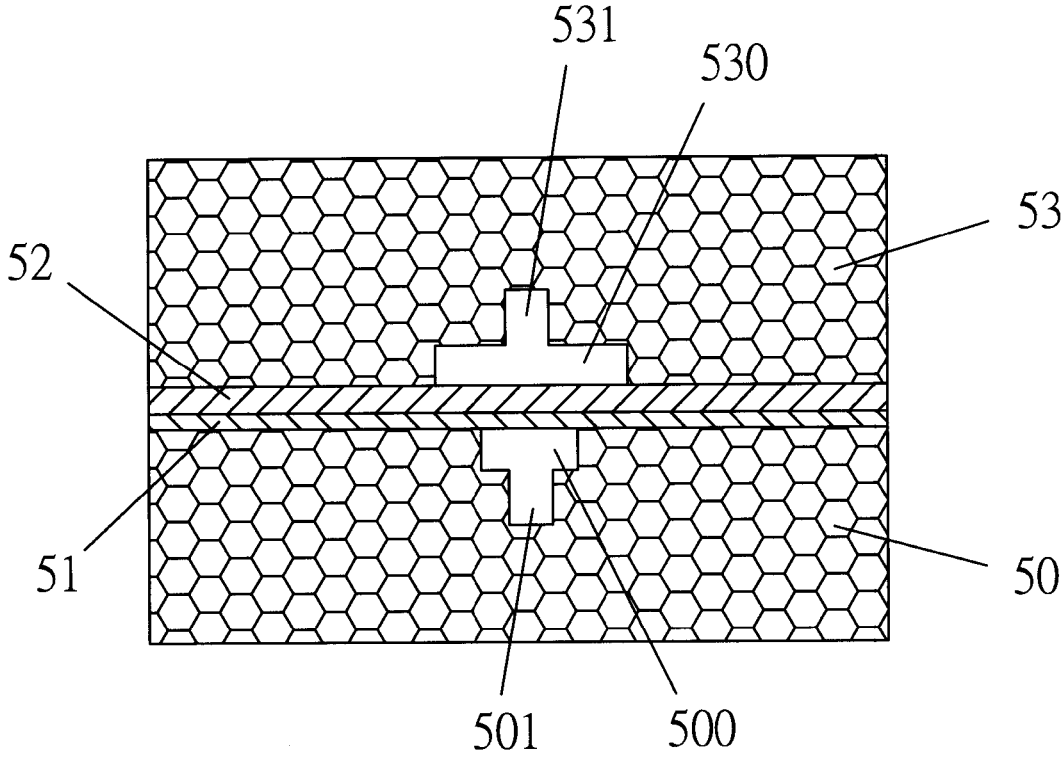
FIG. 6 is a cross-section view partially showing a fifth embodiment of the present invention.

Referring to FIGS. 4, 5, and 6, a third, fourth, fifth embodiments of the current protection device according to the present invention are illustrated respectively. Just like the first embodiment, the embodiments respectively include first substrates 30, 40, 50, support layer 31, 41, 51, circuit layer 32, 42, 52, second substrate 33, 43, 53, and electrodes arranged to the two ends of those stacking substrates (not shown). First recesses 300, 400, and 500 further have first auxiliary recesses 301, 401, and 501 respectively. Second recesses 330, 430, and 530 further have second auxiliary recesses 331, 431, and 531 respectively. One or both the display surfaces of the first substrates 30, 40, 50 and the second substrates 33, 43, 53 have marking.

Referring to FIG. 4, the first recess 300 is larger than the second recess 330.

Referring to FIG. 5, a first recess 400 has the same volume as a second recess 430 does.

Referring to FIG. 6, a first recess 500 is smaller than a second recess 530.

Figure 7:
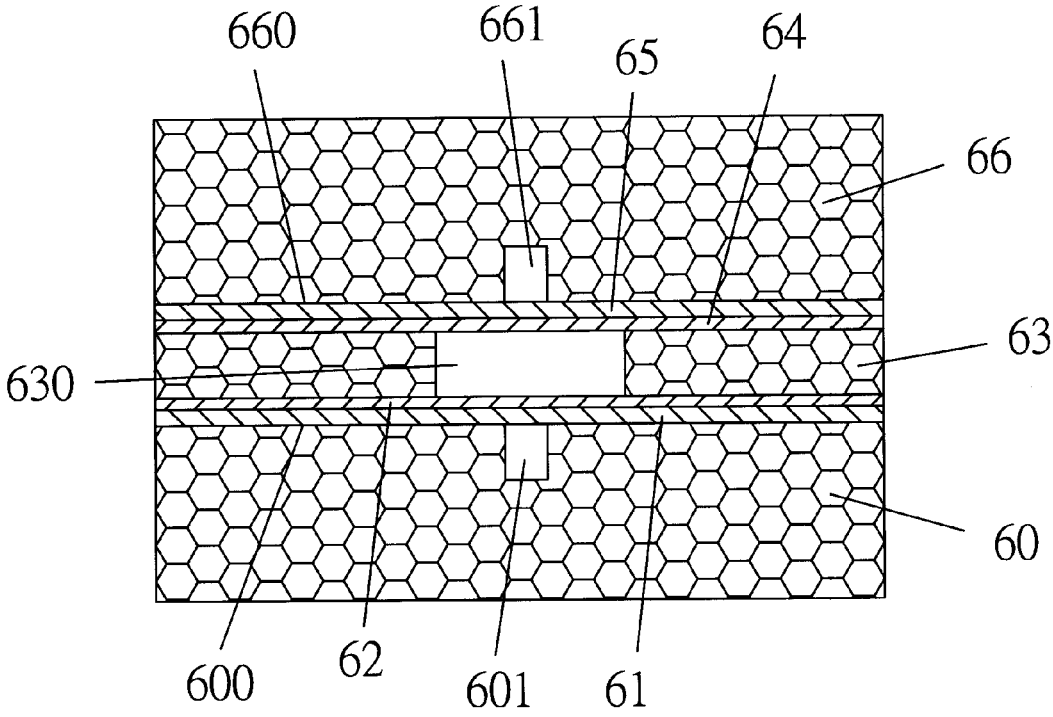
FIG. 7 is a cross-section view partially showing a sixth embodiment of the present invention.

Referring to FIG. 7, a fifth embodiment of the current protection device according to the present invention includes a first substrate 60, first support layer 61, first circuit layer 62, first middle substrate 63, second support layer 64, second circuit layer 65, second substrate 66, and two electrodes (not shown).

An arrangement surface 600 is formed to a surface of the first substrate 60. The arrangement surface 600 has a first recess 601. The first support layer 61 and the first circuit layer 62 are arranged above the arrangement surface 600 in order. The middle substrate 63 is arranged onto the first circuit layer 62. A through hole 630 opposite to the first recess 601 is formed to the middle substrate 63. The second circuit layer 64 and the second support layer 65 are arranged onto the middle substrate 63 in order. The second substrate 66 is arranged onto the second support layer 65 with a contact surface 660 thereof attached to the second support layer 65. The contact surface 660 has a second recess 661. Two electrodes are arranged to the two ends of the stacking substrates of the first substrate 60, first support layer 61, first circuit layer 62, first middle substrate 63, second support layer 64, second circuit layer 65, second substrate 66, and the electrodes are electrically connected to the first and second circuit layers 62 and 64.

Another surface opposite to the contact surface 600 of the first substrate 60 is a display surface, and another surface opposite to the contact surface 660 of the first substrate 66 is a display surface. The two display surfaces can selectively have a marking.

Figure 8:
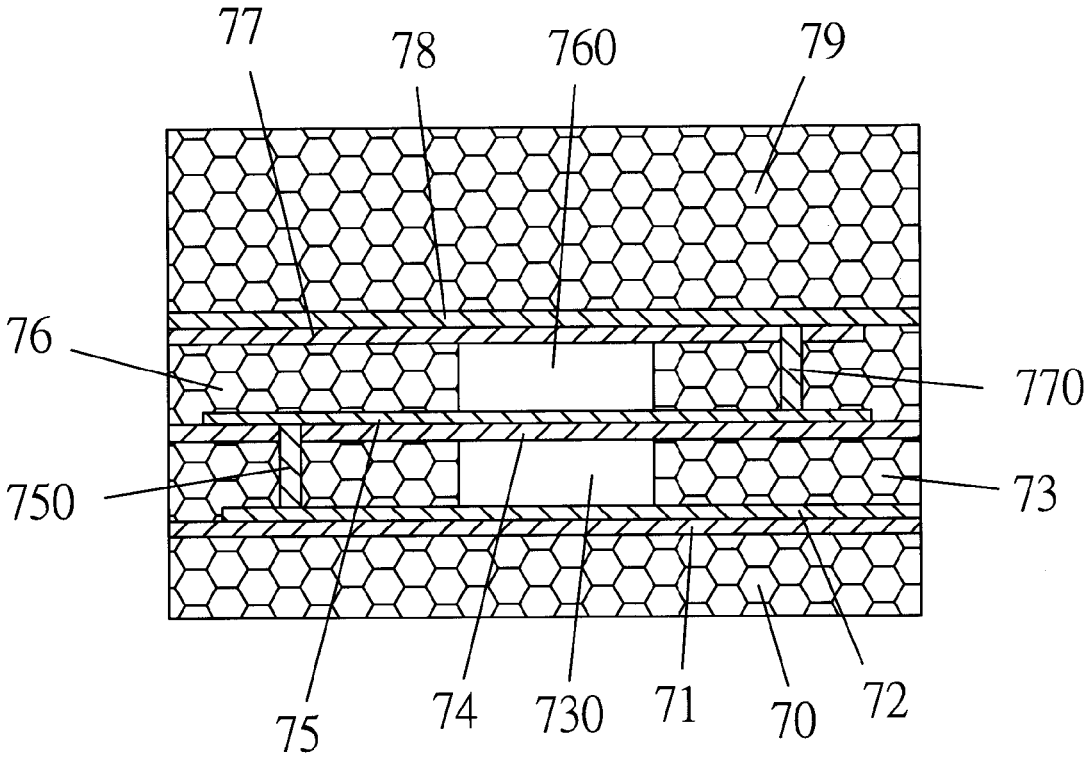
FIG. 8 is a cross-section view partially showing a seventh embodiment of the present invention.

Referring to FIG. 8, a sixth embodiment of the current protection device according to the present invention includes a first substrate 70, first support layer 71, first circuit layer 72, first middle substrate 73, second support layer 74, second circuit layer 75, second middle substrate 76, third circuit layer 77, third support layer 78, and second substrate 79.

The first support layer 71, first circuit layer 72, first middle substrate 73, second support layer 74, second circuit layer 75, second middle substrate 76, third circuit layer 77, third support layer 78, and second substrate 79 are arranged above the first substrate 70 as a stacking substrate. The second circuit layer 75 has an conducting column 750, and the conducting column 750 passes through the second support layer 74 and the first middle substrate 73 so that the first circuit layer 72 and the second circuit layer 75 are electrically connected. The third circuit layer 77 has an conducting column 770, and the conducting column 770 passes through the second middle substrate 76 so that the third circuit layer 77 and the second circuit layer 75 are electrically connected. The first middle substrate 73 has a first through hole 730, and the second middle substrate 76 has a second through holes 760. Two electrodes (not shown) are arranged to two ends of the stacking plates. The first circuit layer 72 is electrically connected to one of the two electrodes and the third circuit layer 77 is electrically connected to another.

The other surface of the first substrate 70 is a display surface, and the other surface of the first substrate 79 is a display surface. The two display surfaces can selectively have a marking.

In the above embodiment, the substrates are ceramic substrates and the conducting columns are made of conducting alloy or conducting composed material.

The recess, auxiliary recess, and the through hole serve to ensure the circuit is blown entirely by over current so as to prevent an arc effect. Moreover, the recess, auxiliary recess, and the through hole can also release the pressure while the circuit is blown.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A current protection device comprising:

a first substrate having an arrangement surface;

a first support layer arranged onto the arrangement surface;

a first circuit layer arranged onto the first support layer;

a middle substrate having a through hole being arranged onto the first circuit layer;

a second circuit layer arranged onto the middle substrate;

a second support layer arranged onto the second circuit layer;

a second substrate arranged onto the second support layer with a contact surface thereof; and two electrodes covering two ends of the above stacking first substrate, first support layer, first circuit layer, middle substrate, second circuit layer, second support layer, and the second substrate; the two electrodes electrically connected to the first and second circuit layers.

2. The current protection device as claimed in claim 1, wherein the arrangement surface has a first recess; the contact surface has a second recess.

3. The current protection device as claimed in claim 1, wherein the first, middle, and the second substrate are made of aluminum oxide ceramic material; the circuit layer is made of one of a conducting alloy or conducting composite material; the first substrate has a display surface, and the second substrate has a display surface; at least one of the display surfaces has a mark of one of specification or words.

4. A current protection device comprising:

a first substrate;

a first support layer arranged onto the first substrate;

a first circuit layer arranged onto the first support layer;

a first middle substrate having a through hole arranged onto the first circuit layer;

a second support layer arranged onto the first middle substrate;

a second circuit layer arranged onto the second support layer; the second circuit layer having a conducting column; the conducting column passing through the second support layer and the first middle substrate to electrically connect the second circuit layer and the first circuit layer;

a second middle substrate having a through hole arranged onto the second circuit layer;

a third circuit layer arranged onto the second middle substrate; the third circuit layer having a conducting column; the conducting column passing through the second middle substrate to electrically connect the third circuit layer and the second circuit layer;

a third support layer arranged onto the third circuit layer;

a second substrate arranged onto the third support layer; and two electrodes covering the two ends of the stacking first substrate, first support layer, first circuit layer, first middle substrate, second support layer, second circuit layer, second middle substrate, third circuit layer, third support layer, and the second substrate; one of the two electrodes being electrically connected to the third circuit layer, and another electrode being electrically connected to the first circuit layer.

5. The current protection device as claimed in claim 4, wherein the first, first middle, second middle, and the second substrate are made of ceramic material; the first, second, and third circuit layer and the conducting columns are made of one of a conducting alloy or conducting composite material; the first substrate has a display surface, and the second substrate has a display surface; at least one of the display surfaces has a mark of one of specification or words.

* * * * *